US011361887B2

(12) United States Patent
Goto et al.

(10) Patent No.: US 11,361,887 B2
(45) Date of Patent: Jun. 14, 2022

(54) MAGNETIC MATERIAL COMPRISING FENI ORDERED ALLOY AND MANUFACTURING METHOD FOR THE SAME

(71) Applicant: DENSO CORPORATION, Kariya (JP)

(72) Inventors: Sho Goto, Kariya (JP); Eiji Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 60 days.

(21) Appl. No.: 16/678,344

(22) Filed: Nov. 8, 2019

(65) Prior Publication Data

US 2020/0075201 A1 Mar. 5, 2020

Related U.S. Application Data

(63) Continuation of application No. PCT/JP2018/018203, filed on May 10, 2018.

(30) Foreign Application Priority Data

May 12, 2017 (JP) ..... JP2017-095788

(51) Int. Cl.
*H01F 1/047* (2006.01)
*C22C 19/03* (2006.01)
(Continued)

(52) U.S. Cl.
CPC ..... *H01F 1/047* (2013.01); *C22C 19/03* (2013.01); *C22C 38/08* (2013.01); *C23C 8/26* (2013.01); *C22C 2202/02* (2013.01)

(58) Field of Classification Search
None
See application file for complete search history.

(56) References Cited

U.S. PATENT DOCUMENTS 7,067,199 B2 6/2006 Hattori et al.
7,244,287 B2 7/2007 Hattori et al.
(Continued)

FOREIGN PATENT DOCUMENTS

JP 2014-105376 A 6/2014
JP 2014-231624 A 12/2014
(Continued)

OTHER PUBLICATIONS

Kojima et al.,"Magnetic Anisotropy and Chemical Order of Artificially Synthesized L10-Ordered FeNiFilms on Au—Cu—Ni Buffer Layers". Japanese Journal of Applied Physics. 51 (2012) (p. 010204-1-3).
(Continued)

*Primary Examiner* — Brian D Walck
(74) *Attorney, Agent, or Firm* — Posz Law Group, PLC

(57) ABSTRACT

A magnetic material includes an FeNi ordered alloy. The FeNi ordered alloy has $L1_0$ ordered structure and is provided as an acicular particle having a longer axis and a shorter axis. A method for manufacturing a magnetic material including an FeNi ordered alloy includes preparing an FeNi disordered alloy provided as an acicular particle, and performing a nitriding treatment of nitriding the FeNi disordered alloy. The magnetic material manufacturing method further includes obtaining an $L1_0$-type FeNi ordered alloy provided as the acicular particle, by performing a denitrification treatment of removing nitrogen from the FeNi disordered alloy on which the nitriding treatment has been performed.

4 Claims, 5 Drawing Sheets

(51) Int. Cl.
*C22C 38/08* (2006.01)
*C23C 8/26* (2006.01)

(56) References Cited

U.S. PATENT DOCUMENTS

| | | | |
|---|---|---|---|
| 7,335,393 | B2 | 2/2008 | Hattori et al. |
| 2004/0033357 | A1 | 2/2004 | Hattori et al. |
| 2013/0228716 | A1 | 9/2013 | Suetsuna et al. |
| 2014/0319406 | A1 | 10/2014 | Suetsuna et al. |
| 2018/0251867 | A1 | 9/2018 | Kura et al. |

FOREIGN PATENT DOCUMENTS

| | | | |
|---|---|---|---|
| JP | 2015-225998 | A | 12/2015 |
| WO | 2012/141205 | A1 | 10/2012 |

OTHER PUBLICATIONS

U.S. Appl. No. 16/672,865, filed Nov. 4, 2019, Kura et al.
U.S. Appl. No. 16/674,132, filed Nov. 5, 2019, Watanabe et al.
U.S. Appl. No. 16/677,755, filed Nov. 8, 2019, Saiga et al.

MAGNETIC MATERIAL COMPRISING FENI ORDERED ALLOY AND MANUFACTURING METHOD FOR THE SAME

CROSS REFERENCES TO RELATED APPLICATIONS

The present application is a continuation application of international Patent Application No. PCT/JP2018/018203 filed on May 10, 2018, which designated the U.S. and claims the benefit of priority from Japanese Patent Application No. 2017-95788 filed on May 12, 2017. The entire disclosures of all of the above applications are incorporated herein by reference.

TECHNICAL FIELD

The present disclosure relates to a magnetic material comprising an $L1_0$-type FeNi ordered alloy having an $L1_0$-type ordered structure, and a manufacturing method for the same.

BACKGROUND

An FeNi ordered alloy of $L1_0$-type comprising Fe (iron) and Ni (nickel) as its main components is expected to be a promising magnet material and a promising magnetic recording material for which no rare earth element and no noble metal are used at all. Here, the $L1_0$ ordered structure is a crystal structure which has a face-centered cubic lattice as its basic structure and in which Fe and Ni are layered in the (001) direction.

SUMMARY

The present disclosure provides a magnetic material comprising an FeNi ordered alloy, and a manufacturing method for the same.

The magnetic material in an aspect of the present disclosure comprises an FeNi ordered alloy that is an $L1_0$-type ordered structure and that is provided as an acicular particle having a longer axis and a shorter axis.

In an aspect of the present disclosure, a method for manufacturing a magnetic material comprising an FeNi ordered alloy comprises: preparing an FeNi disordered alloy provided as an acicular particle; performing a nitriding treatment of nitriding the FeNi disordered alloy; and obtaining an $L1_0$-type FeNi ordered alloy provided as the acicular particle, by performing a denitrification treatment of removing nitrogen from the FeNi disordered alloy on which the nitriding treatment has been performed.

In another aspect of the present disclosure, a method for manufacturing a magnetic material comprising an FeNi ordered alloy comprises: preparing an FeNi disordered alloy provided as an acicular particle; synthesizing a compound in which Fe and Ni are aligned in a same lattice structure as an $L1_0$-type FeNi ordered structure; and removing an unnecessary element being other than Fe and Ni from the compound to generate an $L1_0$-type FeNi ordered alloy provided as the acicular particle, wherein synthesizing the compound includes: synthesizing FeNiN being an intermediate product as the compound by performing a nitriding treatment on the FeNi disordered alloy.

DETAILED DESCRIPTION

Figure 1:
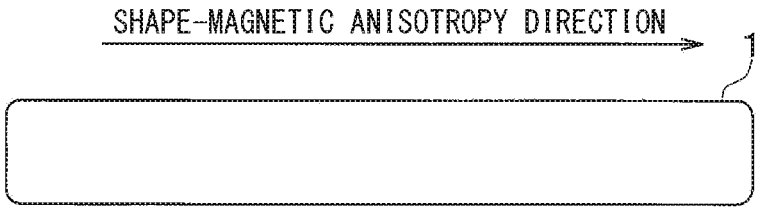
FIG. 1 is a diagram schematically illustrating an $L1_0$-type FeNi ordered alloy provided as an acicular particle according to a first embodiment

An FeNi ordered alloy of $L1_0$-type comprising Fe (iron) and Ni (nickel) as its main components is expected to be a promising magnet material and a promising magnetic recording material for which no rare earth element and no noble metal are used at all. Here, the $L1_0$ ordered structure is a crystal structure which has a face-centered cubic lattice as its basic structure and in which Fe and Ni are layered in the (001) direction. Such an $L1_0$ ordered structure is found in alloys such as FePt, FePd and AuCu and is typically obtainable by thermally treating a random alloy at an order-disorder transition temperature TA or smaller and promoting the diffusion.

In order to use an $L1_0$-type FeNi ordered alloy for a magnet material or a magnetic recording medium, a large coercivity He of 87.5 kA/m or more is required. When a magnetic field is applied to the obtained FeNi ordered alloy, the coercivity He is obtained as the strength of the magnetic field at a time of changeover of a magnetization direction of the FeNi ordered alloy due to the influence of a magnetic field. The coercivity He is expressed in kA/m in the SI unit system, and expressed in Oe [Oersted] in the OGS unit system. Because of 1 A/m=$4\pi\times10^{-3}$ [Oe], the relation 87.5 kA/m=1100 [Oe] is satisfied.

Conventionally, in order to obtain a large coercivity in the $L1_0$-type FeNi ordered alloy, it is proposed to form the L1a-type FeNi ordered alloy into a thin film. When the $L1_0$-type FeNi ordered alloy is formed into a thin film, it has the shape-magnetic anisotropy in one direction of a plane of the thin film, so that the magnetization in this direction is facilitated. This is utilized to obtain a large coercivity.

However, when the $L1_0$-type FeNi ordered alloy is formed into a thin film, Fe elements and Ni elements are layered in a direction perpendicular to the plane of the thin film, that is, in a perpendicular direction perpendicular to the plane. In the L o-type FeNi ordered alloy, the layered direction of Fe and Ni is the c-axis direction which is a magnetization easy axis owing to a magnetocrystalline anisotropy, and thus, the direction of the shape-magnetic anisotropy which is the one direction on the plane is perpendicular to the c-axis direction. Therefore, the shape-magnetic anisotropy cannot be used and a large coercivity cannot be obtained.

It is an object of the present disclosure to provide a magnetic material comprising an FeNi ordered alloy that is usable as a magnet material or a magnetic recording material by having a large coercivity, and a manufacturing method for the same.

The magnetic material in an aspect of the present disclosure comprises an FeNi ordered alloy that is an $L1_0$-type ordered structure and that is provided as an acicular particle having a longer axis and a shorter axis.

In this kind of $L1_0$-type FeNi ordered alloy provided as the acicular particle, a direction of the longer axis matches a direction of shape-magnetic anisotropy. When the $L1_0$-type FeNi ordered alloy is provided as the acicular particle, Fe elements and Ni elements are layered in the direction of the longer axis of the acicular particle. Additionally, in the $L1_0$-type FeNi ordered alloy, the Fe and Ni layered direction matches a direction of c-axis being magnetization easy axis owing to magnetocrystalline anisotropy, and thus, the direction of the longer axis of the acicular particle being the direction of the shape-magnetic anisotropy generally matches the direction of the c-axis. This makes it possible to use the shape-magnetic anisotropy and increase a magnetic anisotropy energy and accordingly increase an anisotropic magnetic field of the $L1_0$-type FeNi ordered alloy. Therefore, application of the magnetic material including the $L1_0$-type FeNi ordered alloy provided as the acicular particle to a magnet material or a magnetic recording material or the like makes it possible to obtain a large coercivity Hc.

In an aspect of the present disclosure, a method for manufacturing a magnetic material comprising an FeNi ordered alloy comprises: preparing an FeNi disordered alloy provided as an acicular particle; performing a nitriding treatment of nitriding the FeNi disordered alloy; and obtaining an $L1_0$-type FeNi ordered alloy provided as the acicular particle, by performing a denitrification treatment of removing nitrogen from the FeNi disordered alloy on which the nitriding treatment has been performed.

The $L1_0$-type FeNi ordered alloy provided as the acicular particle is obtained by: preparing the FeNi disordered alloy provided as the acicular particle; and thereafter performing the nitriding treatment of nitriding the FeNi disordered alloy and the denitrification treatment of removing nitrogen from the nitrided FeNi disordered alloy.

In another aspect of the present disclosure, a method for manufacturing a magnetic material comprising an FeNi ordered alloy comprises: preparing an FeNi disordered alloy provided as an acicular particle; synthesizing a compound in which Fe and Ni are aligned in a same lattice structure as an $L1_0$-type FeNi ordered structure; and removing an unnecessary element being other than Fe and Ni from the compound to generate an L o-type FeNi ordered alloy provided as the acicular particle, wherein synthesizing the compound includes: synthesizing FeNiN being an intermediate product as the compound by performing a nitriding treatment on the FeNi disordered alloy.

In this way, the compound in which Fe and Ni are aligned in the same lattice structure as an $L1_0$-type FeNi ordered structure is synthesized, and the $L1_0$-type FeNi ordered alloy provided as the acicular particle is generated from this compound. This manufacturing method makes it possible to easily synthesize the $L1_0$-type FeNi ordered alloy having a larger coercivity Hc.

Hereinafter, embodiments of the present disclosure will be described with reference to the drawings. In the following embodiments, parts that are the same or equivalent to each other will be described with the same reference numerals.

First Embodiment

A First embodiment will be described. An $L1_0$-type FeNi ordered alloy according to this embodiment, specifically, a magnetic material comprising an FeNi superlattice, is applied to a magnet material, a magnetic recording material, or the like.

Figure 2A:
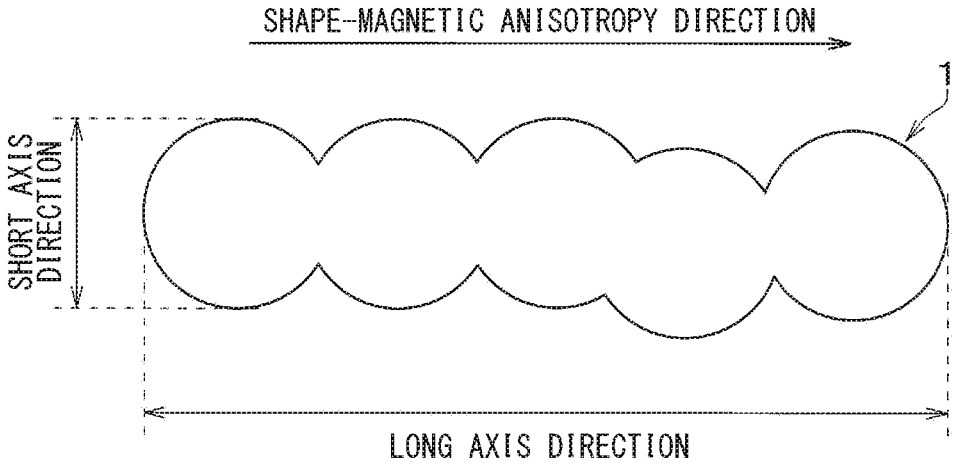
FIG. 2A is a partially enlarged schematic diagram of FIG. 1.
Figure 3:
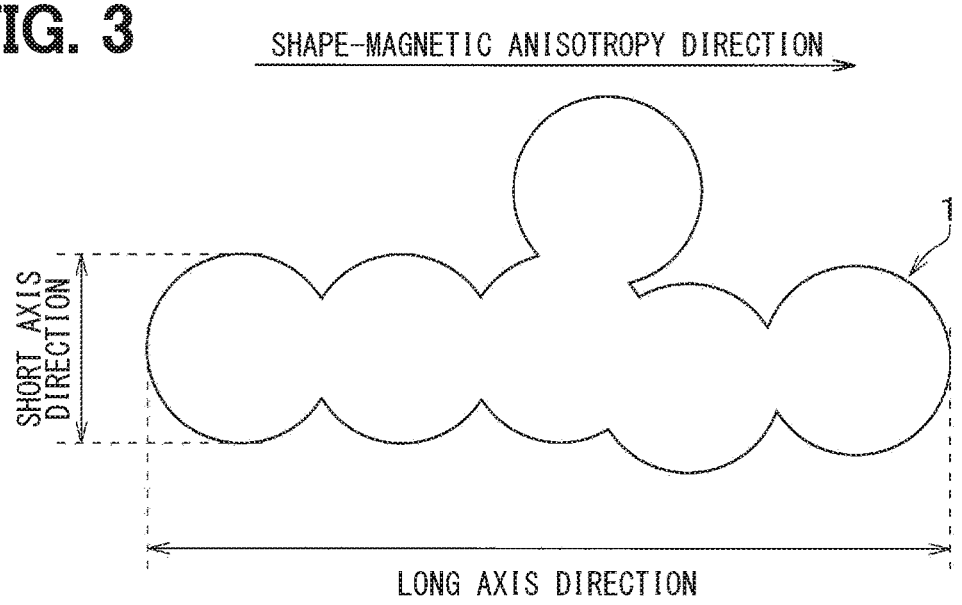
FIG. 3 is a diagram schematically illustrating another structural example of an $L1_0$-type FeNi ordered alloy provided as an acicular particle.

As shown in FIG. 1, the $L1_0$-type FeNi ordered alloy contained in the magnetic material of the present embodiment includes acicular particles. Herein, the acicular particle may mean a particle with an acicular particle structure having a longer axis and a shorter axis as shown in FIG. 1, but actually, as shown in FIG. 2A, a plurality of grains are continuously connected to form the acicular shape. When a plurality of grains are continuously connected to form the acicular shape, it can be considered an acicular particle, and it is not always necessary that all of the grains are connected linearly. Additionally, if the grains have an acicular part, it is included in the acicular particle. For example, as shown in FIG. 3, even when the grains have such a structure in which grains are branched from and connected to the acicular part, the grains are included in the acicular particle.

Figure 2B:
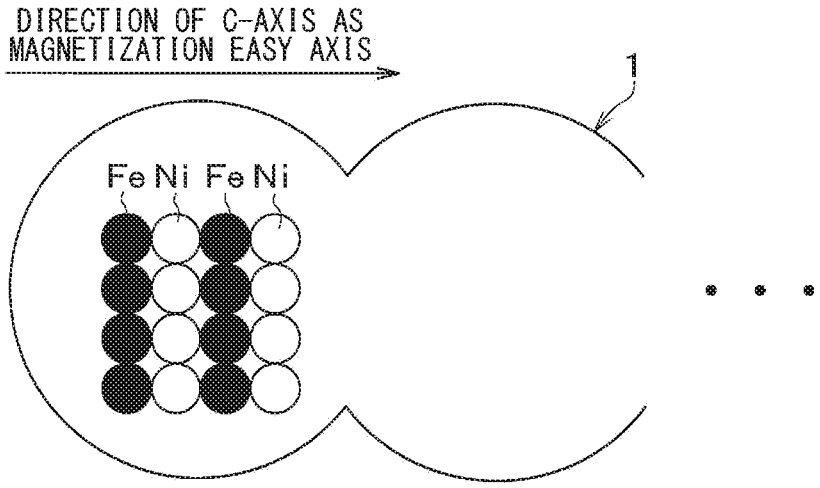
FIG. 2B is a diagram schematically illustrating a relationship between a respective grain constituting an acicular particle and an arrangement of Fe element and Ni elements contained in the respective particle.

In the $L1_0$-type FeNi ordered alloy provided as an acicular particle, the longer axis direction is the direction of shape-magnetic anisotropy, as indicated by the arrow in FIG. 1. When an $L1_0$-type FeNi ordered alloy is formed as the acicular particle, the Fe elements and the Ni elements are layered in a direction along the longer axis of the acicular particle, as shown in FIG. 2B. In the $L1_0$-type FeNi ordered alloy, the layered direction of Fe and Ni is the direction of the c-axis which is the magnetization easy axis owing to magnetocrystalline anisotropy. And thus, the longer axis of the acicular particle, which is the shape-magnetic anisotropy direction, generally matches the direction of the c-axis. Therefore, it is possible to use the shape-magnetic anisotropy and increase the magnetic anisotropy energy, so that the anisotropic magnetic field of the $L1_0$-type FeNi ordered alloy is increased. For this reason, by applying a magnetic material comprising the $L1_0$-type FeNi ordered alloy provided as an acicular particle as in the present embodiment to a magnet material or a magnetic recording material, it is possible to obtain a large coercivity Hc.

It is preferable that the acicular particle constituting this $L1_0$-type FeNi ordered alloy has an aspect ratio of, for example, 1.5 or more, where the aspect ratio is a ratio of the longer axis dimension to the shorter axis dimension. The shorter axis dimension of the acicular particle means the dimension in the shorter axis direction of a respective grain constituting the acicular particle. When the dimensions of respective grains constituting the acicular particle are different, an average value of the shorter axis direction dimensions of respective grains may be used as the shorter axis dimension of the acicular particle. The longer axis dimension of the acicular particle means a linear dimension which is the length of a straight line connected between opposite ends of the acicular part of the acicular particle.

The shape-magnetic anisotropy of the acicular particle constituting the $L1_0$-type FeNi ordered alloy increases as the aspect ratio increases. Experiments and simulations confirmed that when the aspect ratio of the acicular particle is 1.5 or more, the effect of shape-magnetic anisotropy appears and the magnetic anisotropy is obtained in the longer axis direction. In addition, the effect of magnetic anisotropy became more significant as the aspect ratio of the acicular particle increased. The shorter axis dimensions of the acicular particles obtained in the experiments were 20 nm to 250 nm, and when at least the shorter axis dimensions of the acicular particles were within this range, the $L1_0$-type FeNi ordered alloy having the aspect ratio of 1.5 or more had the shape-magnetic anisotropy. For example, in the case of the acicular particle having the shorter axis dimension of 20 nm, the shape-magnetic anisotropy was obtainable in the $L1_0$-type FeNi ordered alloy with the longer axis dimension of 30 nm or more and the aspect ratio of 1.5 or more.

It was also confirmed that when the shorter axis dimension of the acicular particle exceeds size of a single magnetic domain, the coercivity He decreases thereafter. For example, when the shorter axis dimension of the acicular particle was larger than 250 nm, there were cases where the coercivity He decreased. For this reason, it is preferable that the shorter axis dimension of the acicular particle is not too large. Although the shorter axis dimension of the acicular particle may exceed 250 nm of course, the shorter axis dimension of 20 nm or more and 250 nm or less can reliably provide a desired coercivity Hc. The longer axis dimension of the acicular particle is arbitrary as along as the longer axis dimension ensures the aspect ratio is 1.5 or more. When the longer axis dimensions were at least in a range of 30 nm to 750 nm, the large coercivity Hc was obtained.

Next, the manufacturing method of the $L1_0$-type FeNi ordered alloy of the acicular particle concerning the present embodiment will be described.

For example, the $L1_0$-type FeNi ordered alloy of the present embodiment is obtainable by: preparing an FeNi disordered alloy provided as an acicular particle; performing a nitriding treatment of nitriding the FeNi disordered alloy; and then, removing nitrogen from the nitrided FeNi disordered alloy. A disordered alloy is such one in which an arrangement of atoms is irregular and is random.

For example, the FeNi disordered alloy provided as an acicular particle is obtainable by: preparing a diluted FeNi dispersion; and heating the diluted FeNi dispersion to remove moisture. At this time, when the obtained FeNi disordered alloy is an oxide, it may be subjected to hydrogen reduction and the FeNi disordered alloy provided as the acicular particle may be formed. Alternatively, using goethite being a hydroxide of Fe, that is, an acicular hydroxide, the FeNi disordered alloy being an acicular particle is obtainable by heating the hydroxide to remove water. For example, because a hydroxide of Fe and Ni is obtainable by making an aqueous solution containing nickel chloride ($NiCl_2$) in addition to iron chloride ($FeCl_2$), this may be heated to evaporate water, and thereby, the FeNi disordered alloy provided as an acicular particle may be obtained.

Figure 4A:
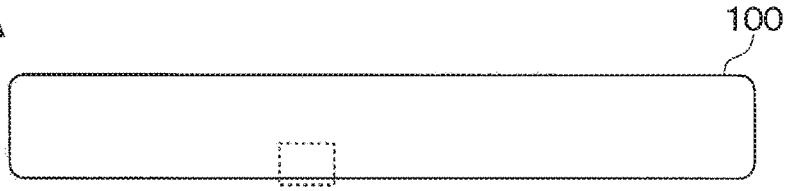
FIG. 4A is a schematic diagram of an FeNi disordered alloy provided as an acicular particle used for manufacturing the $L1_0$-type FeNi ordered alloy illustrated in FIG. 1.
Figure 6:
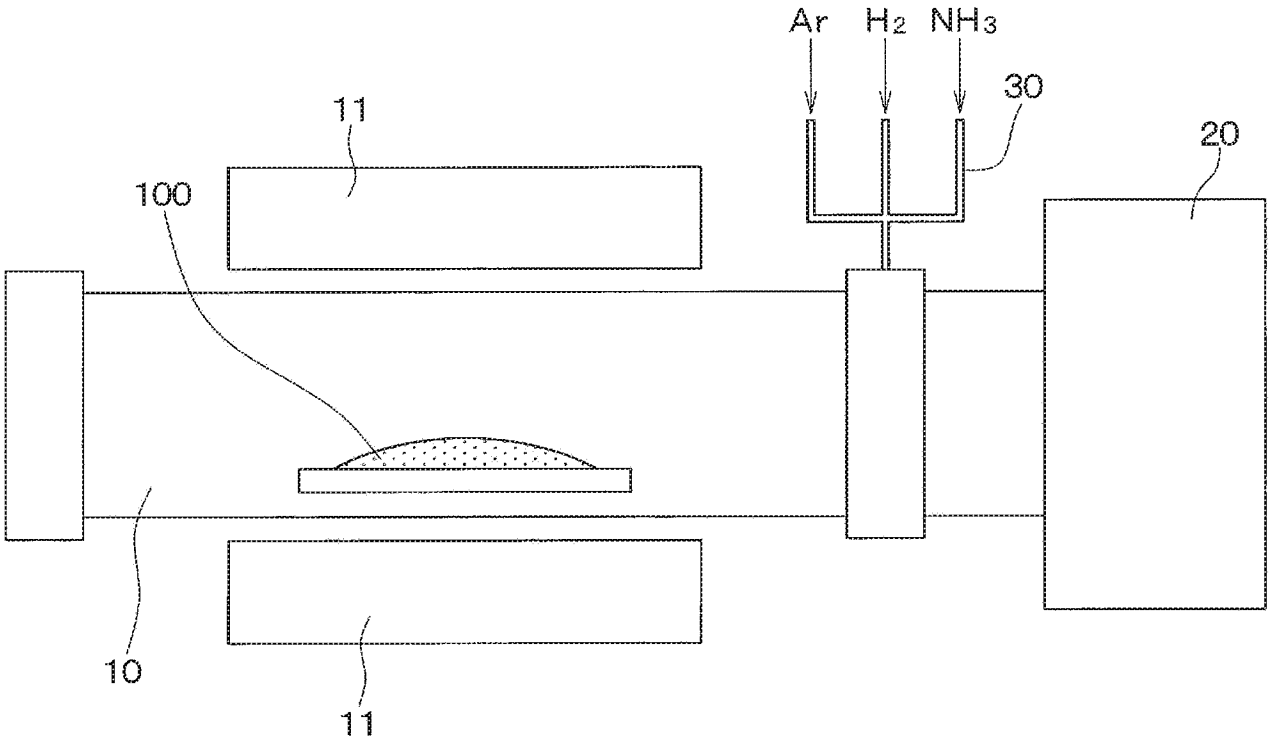
FIG. 6 is a diagram schematically illustrating a configuration of an FeNi ordered alloy manufacturing apparatus.

At this time, the FeNi disordered alloy is an acicular particle as shown in FIG. 4A. As shown in FIG. 6A showing a portion of a respective grain constituting the acicular particle shown by the dashed line in FIG. 4A, the Fe elements and the Ni elements are arranged randomly and without regularity.

Subsequently, a nitriding treatment of nitriding the FeNi disordered alloy and a denitrification treatment of separating nitrogen from the nitrided FeNi disordered alloy are performed. These treatments are performed using, for example, a manufacturing apparatus shown in FIG. 6. The manufacturing apparatus includes: a tubular furnace 10 serving as a heating furnace heated by a heater 11; and a glove box 20 for placing a sample in the tubular furnace 10. In addition, this manufacturing apparatus includes a gas introduction unit 30 that introduce Ar (argon) serving as a purge gas, $NH_3$ (ammonia) for nitriding, and/or $H_2$ (hydrogen) for denitrification into the tubular furnace 10 by switching.

Figure 4B:
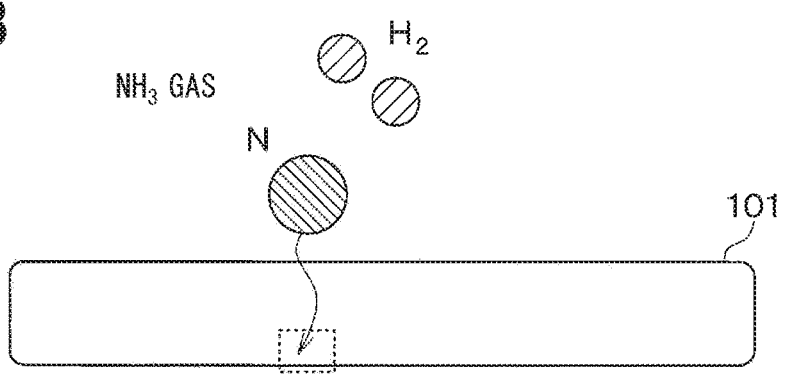
FIG. 4B is a schematic diagram of a structure formed by diffusing N into an FeNi disordered alloy provided as an acicular particle.
Figure 4C:
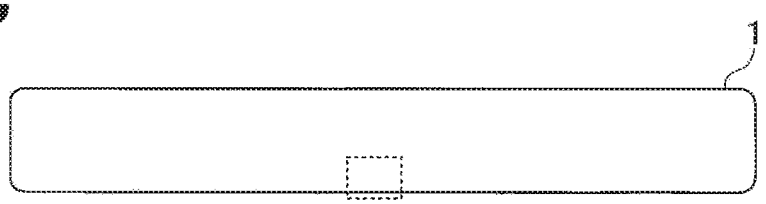
FIG. 4C is a schematic diagram of an FeNi ordered alloy produced from an FeNi disordered alloy.
Figure 5A:
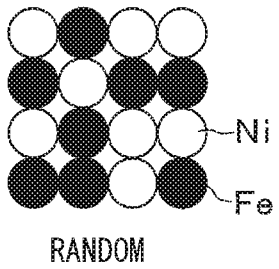
FIG. 5A is a diagram schematically illustrating an arrangement of Fe elements and Ni elements in a part shown by the broken-line in FIG. 4A.
Figure 5B:
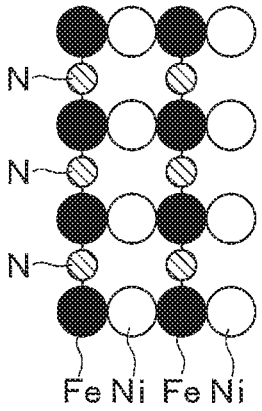
FIG. 5B is a diagram schematically illustrating an arrangement of Fe elements and Ni elements in a part shown by the broken-line in FIG. 4B.

Using such a manufacturing apparatus, first, a nitriding treatment is performed. Specifically, the FeNi disordered alloy 100 is placed in the tubular furnace 10. In the nitriding treatment, the $NH_3$ gas is introduced into the tubular furnace 10 to make the inside of the tubular furnace 10 an $NH_3$ atmosphere, and the FeNi disordered alloy is heated and nitrided at a predetermined temperature for a predetermined time. The treatment temperature for the nitriding treatment is 300 degrees Celsius or more and 500 degrees Celsius or less. The treatment time is 10 hours or more. As a result, as shown in FIG. 4B, $NH_3$ is decomposed on the surface of the FeNi disordered alloy and separated into N and $H_2$, and N diffuses into the FeNi disordered alloy. Then, based on the entering direction of N, ordering occurs in that direction, and as shown in FIG. 5B, a structure 101 in which the Fe elements and the Ni elements are regularly layered is generated, for example, an FeNiN compound is generated.

Figure 5C:
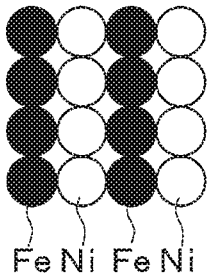
FIG. 5C is a diagram schematically illustrating an arrangement of Fe elements and Ni elements in a part shown by the broken-line in FIG. 4C.

Thereafter, in the denitrification treatment, the $H_2$ gas is introduced into the heating furnace to make the inside of the tubular furnace 10 an $H_2$ atmosphere, and the nitrided FeNi disordered alloy is heated at a predetermined temperature for a predetermined time to remove nitrogen. The treatment temperature of the denitrification treatment is 250 degrees Celsius or higher and 400 degrees Celsius or lower. The treatment time of the denitrification treatment may be as short as 1 hour or less. At this time, even if N is separated from the structure shown in FIG. 5B, the crystal structure at the nitriding treatment is maintained. In this case, provided is the structure in which the grains are continuously connected, wherein the grain have such a structure shown in FIG. 5C where the Fe elements and the Ni elements are layered regularly.

By the above manufacturing method, the $L1_0$-type FeNi ordered alloy 1 provided as the acicular particle according to the present embodiment is manufactured. An investigation of a certain single acicular particle of the $L1_0$-type FeNi ordered alloy 1 manufactured by an experiment showed that the shorter axis dimension was 49.2 nm, the longer axis dimension was 137.7 nm, and the aspect ratio was 2.8.

Figure 7:
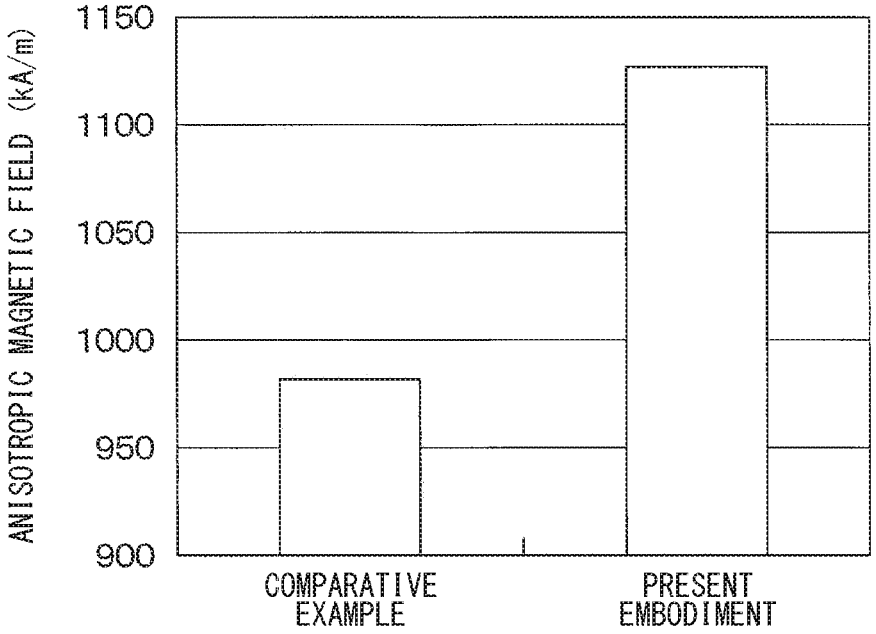
FIG. 7 is a diagram showing a result of measuring anisotropic magnetic fields of $L1_0$-type FeNi ordered alloys of a first embodiment and a comparative example.

As a comparative example, an $L1_0$-type FeNi ordered alloy 1 provided not as the acicular particle but a simple granular particular was manufactured by an experiment through performing the above nitriding treatment of nitriding the FeNi disordered alloy and then performing a denitrification treatment of separating nitrogen. Then, the anisotropic magnetic field was measured for the $L1_0$-type FeNi ordered alloy 1 provided as the acicular particle as in the present embodiment and for the $L1_0$-type FeNi ordered alloy provided as the simple granular particle as in the comparative example. As shown in FIG. 7, the result is that the anisotropic magnetic field was 981 kA/m in the comparative example, whereas a large anisotropic magnetic field of 1128 kA/m was obtained in the present embodiment. It is considered that a reason why the anisotropic magnetic field in the comparative example did not increase sufficiently is that in the case of the simple granular $L1_0$-type FeNi ordered alloy, places for N entry were not determined and there was a variety of c-axis directions and there was no anisotropy. On the other hand, it is considered that a reason why the obtained anisotropic magnetic field was large in the case of the acicular particle $L1_0$-type FeNi ordered alloy as in the present embodiment is that the places for N entry were determined and the c-axis directions were the same and there was anisotropy.

These experiment results also show that it is possible to obtain the $L1_0$-type FeNi ordered alloy provided as the acicular particle as in the present embodiment with a large coercivity He that is usable as a magnet material or a magnetic recording material.

Second Embodiment

A second embodiment will be described. The present embodiment can further increase the coercivity He as compared with the first embodiment. The manufacturing processes in the present embodiment are basically the same as those in the first embodiment. Explanation will be given on differences from the first embodiment only.

The present embodiment increases the coercivity He by generating an intermediate product in generating the $L1_0$-type FeNi ordered alloy from the FeNi disordered alloy. While the first embodiment performs the nitriding treatment and the denitrification treatment, the present embodiment generates FeNiN as an intermediate product at a time of completion of the nitriding treatment. In order to properly generate the intermediate product by the nitriding treatment, an oxide film formed on a surface of the FeNi disordered alloy is removed prior to the nitriding treatment. Thereafter, the denitrification treatment is performed on the FeNiN being the intermediate product, and thereby, the $L1_0$-type FeNi ordered alloy is formed.

Figure 8:
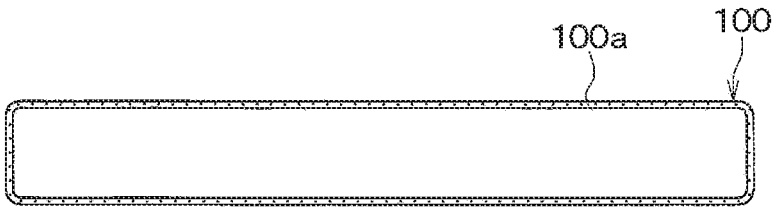
FIG. 8 is a diagram schematically illustrating an $L1_0$-type FeNi disordered alloy provided as an acicular particle according to a second embodiment.

First, an FeNi disordered alloy formed as an acicular particle is prepared. Then, as shown in FIG. 8, since the oxide film 100*a* is formed on the surface of the FeNi disordered alloy, a removal treatment of removing the oxide film 100*a* on the surface of the FeNi disordered alloy is performed prior to the nitriding treatment. Thereafter, the nitriding treatment is performed continuously following the removal treatment.

As the removal treatment, a heat treatment is performed, for example, between 300 degrees Celsius and 450 degrees Celsius in an etching atmosphere of the oxide film 100*a*. As a result, the oxide film 100*a* on the surface of the FeNi disordered alloy is removed, resulting in a nitriding-easy surface state. As the nitriding treatment, a heat treatment is performed in an atmosphere containing N, for example, between 200 degrees Celsius to 400 degrees Celsius. As a result, the FeNi disordered alloy from which the oxide film has been removed and which has become the nitriding-easy surface state is properly nitride. Note that because the nitriding treatment is performed after removing the oxide film 100*a*, the nitriding reaction is facilitated and the temperature may be lower than that in the first embodiment. For this reason, the temperature of the nitriding treatment is set to 200 degrees Celsius to 400 degrees Celsius but this temperature may be exceeded, and it may be set to 500 degrees Celsius or less as in the first embodiment.

Next, a denitrification treatment is performed on the FeNiN being the intermediate product. As the denitrification treatment, a heat treatment is performed in a denitrification atmosphere, for example, between 200 degrees Celsius to 400 degrees Celsius. Accordingly, nitrogen is separated from the intermediate product, and the $L1_0$-type FeNi ordered alloy is formed. By forming FeNiN acting as the intermediate product and then forming the $L1_0$-type FeNi ordered alloy in the above way, it is possible to obtain a larger coercivity Hc.

In the present embodiment as described above, the FeNi disordered alloy is subjected to the nitriding to produce the intermediate product being FeNiN, and further, the intermediate product is subjected to the denitrification treatment to produce the $L1_0$-type FeNi ordered alloy. This manufacturing method makes it possible to more properly produce the $L1_0$-type FeNi ordered alloy having obtain a larger coercivity Hc.

In particular, the intermediate product is more properly generable by performing the nitriding treatment after performing the removal treatment of removing the oxide film 100*a* formed on the surface of the FeNi disordered alloy. Therefore, the removal treatment makes it possible to obtain the $L1_0$-type FeNi ordered alloy having a larger coercivity Hc.

Other Embodiments

Although the present disclosure has been described in accordance with the above-described embodiments, the present disclosure is not limited to the embodiments, and covers various modifications and variations within the equivalent range. In addition, various combinations and forms, as well as other combinations and forms including only one, more or less element, are also within the spirit an scope of the present disclosure.

For example, in the above embodiments, the $L1_0$-type FeNi ordered alloy provided as the acicular particle is obtained by performing the nitriding treatment and the denitrification treatment. However, the L o-type FeNi ordered alloy may be obtain by other than the nitriding treatment and the denitrification treatment. Specifically, the $L1_0$-type FeNi ordered alloy provided as the acicular particle may be obtained by: performing a process of synthesizing a compound in which Fe and Ni are aligned in the same lattice structure as the $L1_0$-type FeNi ordered structure; and thereafter performing a process of removing an unnecessary element being other than Fe and Ni from this compound.

The above embodiments illustrate examples of the conditions of the nitriding treatment and the denitrification treatment. However, a respective condition illustrated above is merely an example. Specifically, as long as the $L1_0$-type FeNi ordered alloy provided as the acicular particle is obtainable by a nitriding treatment and a denitrification treatment, the treatment temperatures and the treatment times of these treatments are not limited to the above examples.

Similarly, although the second embodiment illustrates examples of the conditions of the removal treatment, the nitriding treatment, and the denitrification treatment of the oxide film 100*a*, these are merely examples of the conditions. Specifically, these treatment conditions are arbitrary as long as the $L1_0$-type FeNi ordered alloy provided as the acicular particle is obtainable.

What is claimed is:

1. A magnetic material comprising an FeNi ordered alloy, the FeNi ordered alloy having an $L1_0$ ordered structure and provided as an acicular particle having a longer axis and a shorter axis, wherein an aspect ratio of the acicular particle, which is a ratio of a dimension of the longer axis of the acicular particle to a dimension of the shorter axis of the acicular particle, is 1.5 or more, and the dimension of the shorter axis of the acicular particle is 20 nm to 250 nm.

2. The magnetic material comprising the FeNi ordered alloy according to claim 1, wherein a direction of a magnetization easy axis being a layered direction of Fe and Ni constituting the FeNi ordered alloy is aligned with a direction of the longer axis of the acicular particle.

3. The magnetic material comprising the FeNi ordered alloy according to claim 1, wherein the acicular particle has an acicular shape formed by a plurality of continuously connected grains.

4. The magnetic material comprising the FeNi ordered alloy according to claim 1, wherein the dimension of the longer axis of the acicular particle is 30 nm to 750 nm.

* * * * *